US008547299B2

(12) United States Patent
Jeong et al.

(10) Patent No.: US 8,547,299 B2
(45) Date of Patent: Oct. 1, 2013

(54) FIELD EMISSION DEVICE AND DRIVING METHOD THEREOF

(75) Inventors: Jin Woo Jeong, Daejeon (KR); Yoon Ho Song, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 1029 days.

(21) Appl. No.: 12/575,054

(22) Filed: Oct. 7, 2009

(65) Prior Publication Data

US 2010/0244717 A1 Sep. 30, 2010

(30) Foreign Application Priority Data

Mar. 30, 2009 (KR) ..... 10-2009-0026868

(51) Int. Cl.
*G09G 3/10* (2006.01)

(52) U.S. Cl.
USPC ..... 345/75.2; 315/169.1

(58) Field of Classification Search
USPC ..... 315/169.1, 169.2, 169.3; 313/309, 313/310, 495, 444, 446, 447, 448, 449, 422; 345/75.1, 75.2, 76, 77, 78
See application file for complete search history.

(56) References Cited

U.S. PATENT DOCUMENTS

| | | | | |
|---|---|---|---|---|
| 5,850,120 | A * | 12/1998 | Okamoto | 313/336 |
| 6,127,774 | A * | 10/2000 | Janning | 313/309 |
| 6,163,107 | A * | 12/2000 | Itoh et al. | 313/495 |
| 6,377,002 | B1 | 4/2002 | Ge et al. | |
| 6,441,559 | B1 * | 8/2002 | Yamamoto et al. | 315/169.1 |
| 6,747,416 | B2 * | 6/2004 | Barger et al. | 315/169.3 |
| 2007/0171152 | A1 * | 7/2007 | Iguchi et al. | 345/75.2 |

FOREIGN PATENT DOCUMENTS

| | | | |
|---|---|---|---|
| KR | 10-2004-0073747 | A | 8/2004 |
| KR | 10-2005-0106304 | A | 11/2005 |
| KR | 10-2008-0017241 | | 2/2008 |

* cited by examiner

*Primary Examiner* — Minh D A
(74) *Attorney, Agent, or Firm* — Rabin & Berdo, P.C.

(57) ABSTRACT

Provided is a pulse drive-type field emission device. The pulse drive-type field emission device includes anode and cathode substrates that are spaced apart from and face each other, a cathode electrode formed on the cathode substrate, and a field emitter formed on the cathode electrode. The pulse drive-type field emission device further includes a metal mesh-type gate electrode having an opening through which electrons emitted from the field emitter pass and a power source which applies a compensated pulse wave power to the gate electrode or the cathode electrode to compensate for vibration of the gate electrode. Thus, noise from the metal mesh can be prevented without additional fabrication processes by modifying a waveform in pulse driving.

16 Claims, 5 Drawing Sheets

FIELD EMISSION DEVICE AND DRIVING METHOD THEREOF

This application claims the benefit of Korean Patent Application No. 10-2009-0026868, filed Mar. 30, 2009, the contents of which are hereby incorporated herein by reference in their entirety.

BACKGROUND OF THE INVENTION

1. Field of the Invention

The present invention relates to a field emission device, and more particularly, to a field emission device capable of decreasing noise made in a metal mesh-type gate electrode thereof and a driving method thereof.

2. Description of Related Art

A field emission device includes a gate electrode for inducing electrons from a field emitter and concentrating emitted electrons to a particular region of an anode.

The gate electrode may be formed as a metal mesh-type electrode whose both ends are fixed to a cathode substrate.

In general, a field emission device and a field emission display require pulse driving to guarantee durability of a field emitter or represent dynamic gradation.

However, such pulse driving produces noise due to vibration of the metal mesh-type electrode.

To prevent such noise, it is necessary to tightly fix a metal mesh-type electrode to a cathode substrate or design a frequency of the noise to be outside of an audible frequency range by adjusting intervals of spacers which are vibration axes. However, this is not easy in a fabrication process.

SUMMARY OF THE INVENTION

The present invention is directed to providing a field emission device capable of decreasing noise in a metal mesh-type gate electrode which is not fixed is tightly to a cathode substrate.

One aspect of the present invention provides a pulse drive-type field emission device including: an anode substrate and a cathode substrate spaced apart from and facing each other; a cathode electrode formed on the cathode substrate; a field emitter formed on the cathode electrode; a metal mesh-type gate electrode formed between the anode substrate and the cathode substrate, and having openings through which electrons emitted from the field emitter pass; and a power source configured to apply a compensated pulse wave voltage to the gate electrode or the cathode electrode which compensates for vibration of the gate electrode.

The power source may include a cathode power source which applies power to the cathode electrode and a gate power source which applies power to the gate electrode.

The cathode power source may include a current control device which controls a current flow in the cathode electrode.

The current control device may include: a pulse generator configured to generate a pulse voltage which repeatedly rises and falls with time; and a transistor configured to receive the pulse voltage from the pulse generator and connect or disconnect the cathode electrode to or from the ground.

The pulse voltage applied to the transistor may have a shape of a is pentagonal wave.

A duty of the pentagonal pulse wave voltage and maximum and minimum values of a turn on voltage may be determined according to characteristics of the transistor.

The gate power source may apply a pentagonal pulse wave voltage for inducing electron emission from the field emitter to the gate electrode, and the cathode power source may apply a constant voltage with time to the cathode electrode.

The field emission device may further include: an inducing gate electrode formed between the metal mesh-type gate electrode and the cathode electrode, and an inducing gate power source configured to apply inducing gate power to the inducing gate electrode.

The induction gate power source may apply a pentagonal pulse wave voltage to the induction gate electrode.

The field emitter may be formed of one of a carbon nano tube, a carbon nano fiber and carbonaceous synthetic materials.

Another aspect of the present invention provides a driving method of a pulse drive-type field emission device having an anode substrate, a stacked structure of a field emitter and a cathode electrode on a cathode substrate, the cathode is substrate being spaced apart from and facing the anode substrate and a metal mesh-type gate electrode formed between the anode substrate and the cathode substrate. The method includes: applying a gate voltage to the gate electrode; generating a pentagonal pulse wave voltage having a greater duty than a pulse duty of the cathode electrode, and decreasing a change rate in voltage of the cathode electrode by controlling a current of the cathode electrode according to the pentagonal pulse wave voltage.

The decreasing of the change rate in voltage of the cathode electrode may include connecting or disconnect the cathode electrode to or from the ground by turning a transistor on or off according to the pentagonal pulse wave voltage.

A duty of the pentagonal pulse wave voltage and maximum and minimum values of a turn on voltage may be determined according to characteristics of the transistor.

Still another aspect of the present invention provides a driving method to of a pulse drive-type field emission device having an anode substrate, a stacked structure of a field emitter and a cathode electrode on a cathode substrate, the cathode substrate being spaced apart from and facing the anode substrate and a gate electrode between the anode substrate and the cathode substrate. The method includes: applying a constant voltage with time to the cathode electrode; generating is a pentagonal pulse wave voltage having a greater duty than a pulse duty of the gate electrode; and applying the pentagonal pulse wave voltage to the gate electrode.

The gate electrode may be a metal mesh-type electrode.

The field emission device may include a metal mesh-type gate electrode and an inducing gate electrode, and the applying of the pentagonal pulse wave voltage may include: applying a constant voltage with time to the metal mesh-type gate electrode; and applying the pentagonal pulse wave voltage to the inducing gate electrode.

BRIEF DESCRIPTION OF THE DRAWINGS

The above and other features of the present invention will be described in reference to certain exemplary embodiments thereof with reference to the attached drawings in which.

DETAILED DESCRIPTION OF THE INVENTION

Figure 1:
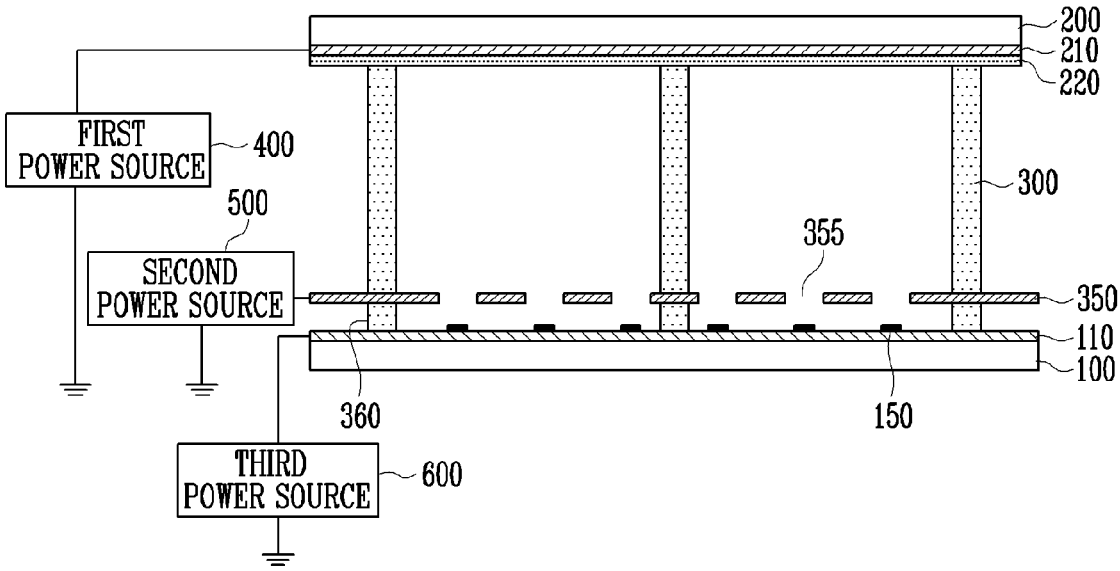
FIG. 1 is a cross sectional view of a field emission device according to a first exemplary embodiment of the present invention.

The present invention will be described more fully hereinafter with reference to the accompanying drawings, in which exemplary embodiments of the invention are shown. This invention may, however, be embodied in different forms and should not be construed as limited to the embodiments set forth herein. In the drawings, portions irrelevant to a description of the present invention are omitted for clarity, and like reference numerals denote like elements.

Throughout the specification, it will be understood that when a portion "comprises" an element, it is not intended to exclude other elements but can further include other elements.

Hereinafter, exemplary embodiments of the present invention will be is described in detail with reference to the accompanying drawings.

Figure 2:
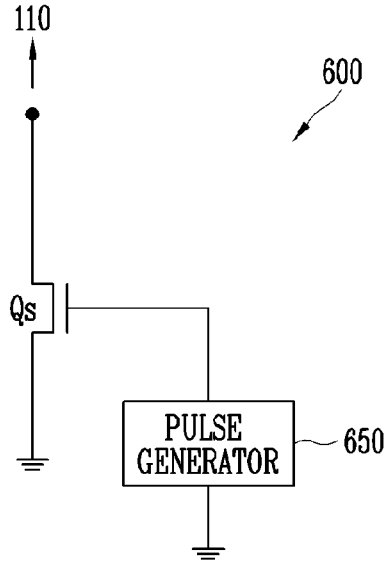
FIG. 2 is a diagram of a third power source shown in FIG. 1.

FIG. 1 is a cross sectional view of a field emission device according to a first exemplary embodiment of the present invention, and FIG. 2 is a diagram of a third power source shown in FIG. 1.

Referring to FIG. 1, in the field emission device according to a first exemplary embodiment of the present invention, a cathode substrate 100 and an anode substrate 200 are spaced apart from each other by spacers 300 and face each other.

A cathode electrode 110 is formed on the cathode substrate 100, and a plurality of field emitters 150 are formed to be spaced apart on the cathode electrode 110.

An anode electrode 210 is formed on the anode substrate 200 spaced apart from the cathode substrate 100 in a direction facing the cathode substrate 100, and a fluorescent layer 220 is formed on the anode electrode 210.

Likewise, a gate electrode 350 is formed between the cathode substrate 100 and the anode substrate 200 which face each other.

The gate electrode 350 is formed in a metal mesh type to include holes exposing the field emitters 150 on the cathode substrate 100.

Between ends of the gate electrode 350 and the cathode electrode 110, is insulating spacers 360 are formed to support the metal mesh-type gate electrode 350.

Also, the field emission device includes a first power source 400 supplying power to the anode electrode 210, a second power source 500 supplying power to the gate electrode 350, and a third power source 600 supplying power to the cathode electrode 110.

By controlling the first to third power sources 400, 500 and 600, it is possible to prevent noise according to vibration of the metal mesh-type gate electrode 350.

As an example, a constant high level DC voltage with time may be supplied to the anode electrode 210 and the gate electrode 350 from the first and second power sources 400 and 500. And a pulse current may be supplied to the cathode electrode 110 from the third power source 600.

This third power source 600 includes a current switching circuit as shown in FIG. 2, and controls a field emission current by a pulse.

Referring to FIG. 2, the third power source 600 includes a pulse generator 650 and a switching device Qs.

The switching device Qs may be a high voltage metal oxide semiconductor field effect transistor (MOSFET).

In the third power source 600, pulse voltage signals output from the grounded pulse generator 650 are applied to a gate of the switching device Qs (a transistor), a source of the transistor Qs is grounded, and a drain of the transistor Qs is connected to the cathode electrode 110.

Current switching of the transistor Qs is turned on by low voltage signals (below 5V) of the pulse generator 650, and thus electric charges of the cathode electrode 110 flow to the ground.

Figure 3:
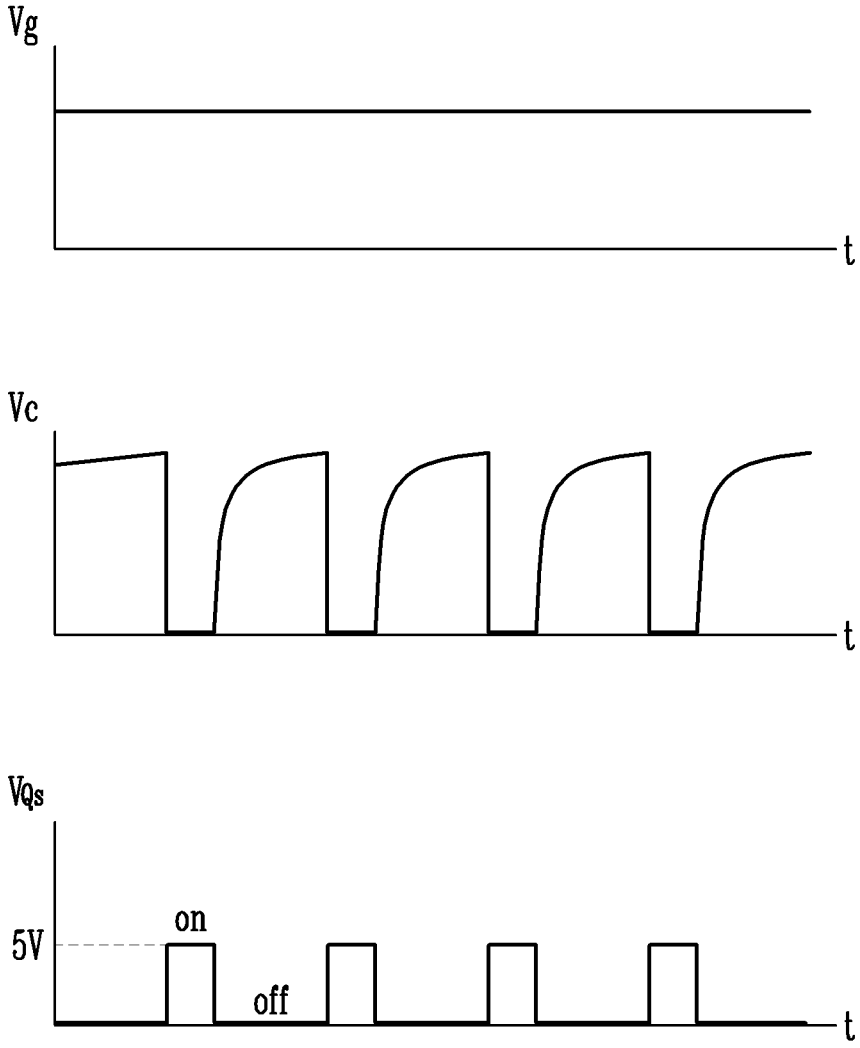
FIG. 3 is a diagram showing changes in voltage of a cathode electrode and a gate electrode during pulse driving in a current drive method.

FIG. 3 is a diagram showing changes in voltage of a cathode electrode and a gate electrode during pulse driving in a current drive method, and FIG. 4 is a diagram showing vibration of a gate electrode according to changes in voltage of a cathode electrode.

As shown in FIG. 3, when the field emission device is pulse-driven in a current drive method, the transistor Qs is turned on or off according to pulse signals applied to the gate of the transistor Qs, and thus the voltage of the cathode electrode 110 is controlled.

In other words, when 0V is applied to the gate of the transistor Qs, the transistor Qs is turned off, and a cathode current is cut off and field emission does not occur.

However, when a voltage higher than a threshold voltage, for example, below 5 V and over 0 V, is applied to the transistor Qs, the transistor Qs is turned on and field emission occurs.

Here, a gate voltage sufficient for an electric field to be applied should be applied to the gate electrode 350 of the field emission device so that the field emitters 150 can perform field emission, and a voltage sufficient to accelerate emitted electrons should be applied to the anode electrode 210.

In other words, as shown in FIG. 3, because a constant voltage Vg is applied to a mesh-type gate electrode, there is no voltage change with time. But, as the transistor Qs is turned on and off repeatedly, a voltage $V_{Qs}$ of the cathode electrode 110 is changed.

Specifically, when the transistor Qs is turned on, the cathode electrode 110 is connected to the ground through the transistor Qs, and thus the voltage $V_{Qs}$ is 0V. Further, when the transistor Qs is turned off, a connection between the cathode electrode 110 and the ground is terminated and the cathode electrode 110 is in a floating state. Thus, the voltage $V_{Qs}$ is relatively higher due to a voltage of the adjacent gate electrode 350.

Consequently, while pulse driving continues, the voltage $V_{Qs}$ of the cathode electrode 110 repeatedly rises and falls as shown in FIG. 3.

Hereinafter, vibration of a gate electrode 350 according to changes in voltage of a cathode electrode will be described with reference to FIGS. 4A and 4B.

Figure 4A:
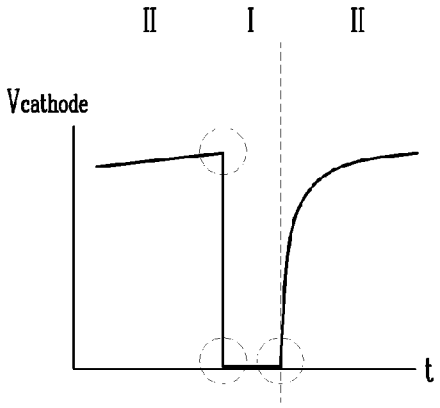
FIGS. 4A and 4B are diagrams showing vibration of a gate electrode according to changes in voltage of a cathode electrode.

As shown in first region I of FIG. 4A, when the cathode electrode 110 and the ground are connected and a voltage $V_{cathode}$ of the cathode electrode 110 falls, the metal mesh-type gate electrode 350 facing the cathode electrode 110 is attracted by the cathode electrode 110, and thus is deflected towards the cathode substrate 100.

On the other hand, as shown in second region II of FIG. 4A, when the cathode electrode 110 and the ground are open, and the voltage $V_{cathode}$ of the cathode electrode 110 is relatively high, either the attraction between the gate electrode 350 and the cathode electrode 110 is weakened or repulsion occurs. Thus, the metal mesh-type gate electrode 350 is deflected towards the anode substrate 200.

Here, the degree and direction of the deflection may be determined conversely according polarities and sizes of the cathode electrode 110 and the gate electrode 350.

Figure 4B:
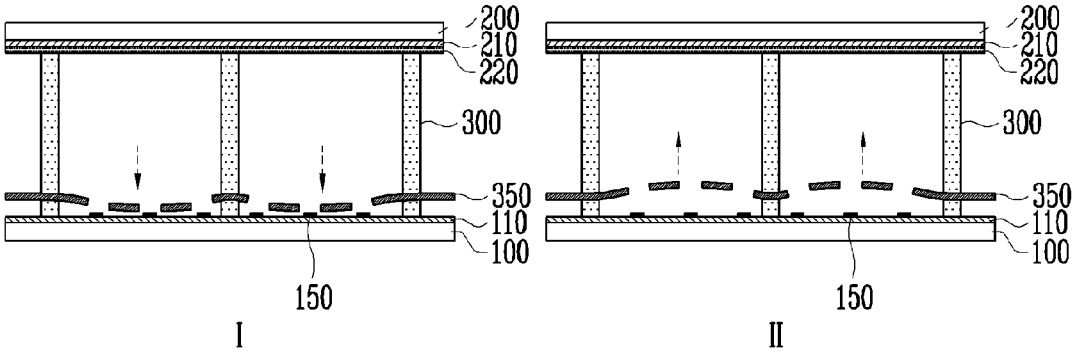

As shown in FIG. 4B, when vibration is generated in the mesh-type gate electrode 350 during pulse driving, noise is generated due to vibration of the metal mesh-type gate electrode 350.

In other words, when a voltage rises or falls dramatically, a physical shape of the metal mesh may be changed dramatically, and thus a shockwave caused by this generates noise.

Figure 5:
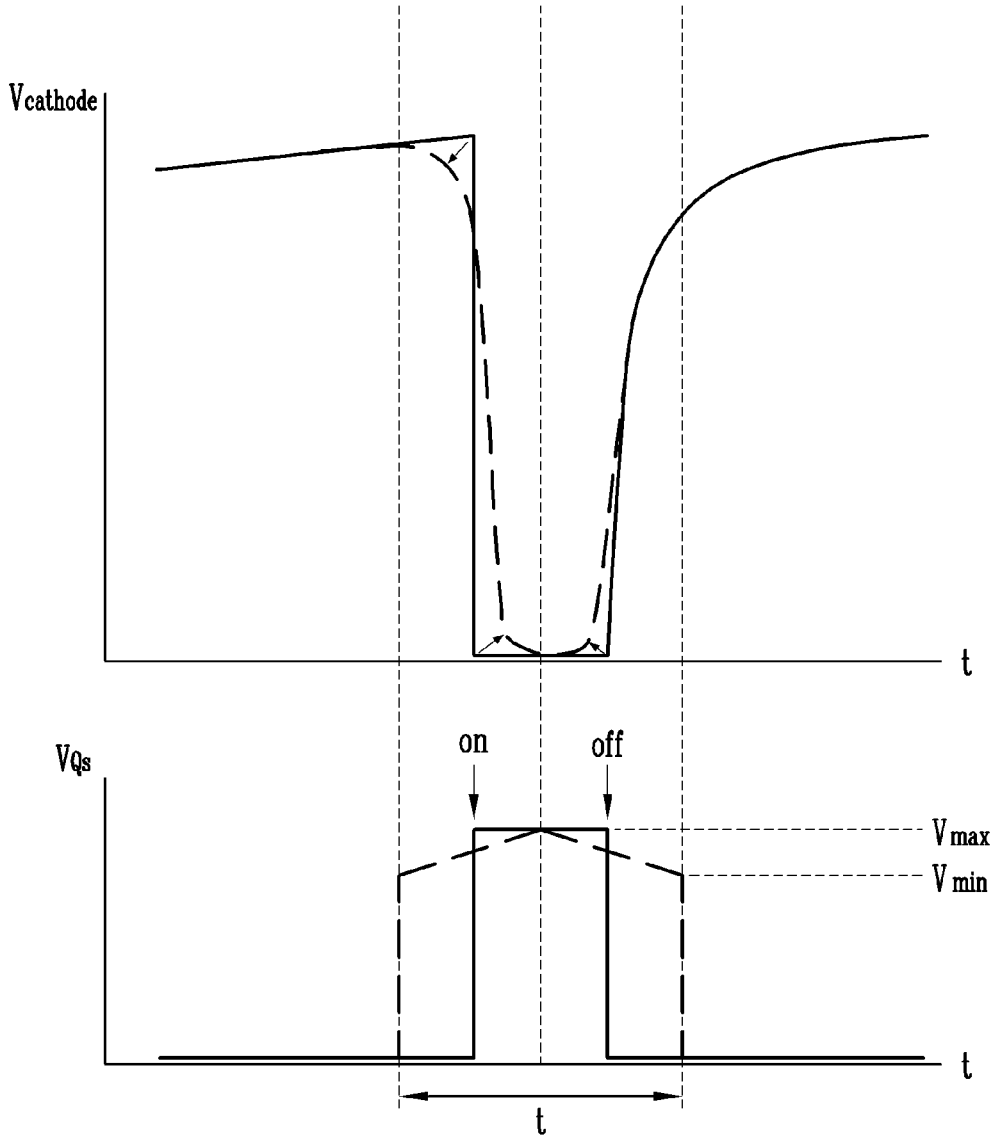
FIG. 5 is a waveform diagram of signals for explaining a driving waveform according to a first exemplary embodiment of the present invention.

Accordingly, in order to decrease the noise, a waveform of a power is source is modified as shown in FIG. 5.

FIG. 5 is a waveform diagram of signals for explaining a driving waveform according to a first exemplary embodiment of the present invention.

Referring to FIG. 5, a solid line in the diagram represents a comparative example showing changes in voltage of the cathode electrode 110 of the field emission device when an ordinary square wave pulse is input into a gate of the transistor Qs of the third power source 600, and a dotted line represents an example showing a driving waveform according to a first exemplary embodiment of the present invention.

In the comparative example shown in FIG. 5, the voltage $V_{cathode}$ of the cathode electrode is dropped when a turn-on voltage is applied to the gate of the transistor Qs, and thus a physical change of the metal mesh generates a shockwave and noise is generated. When a turn-off voltage is applied, noise is generated for the same reason.

Here, when a voltage of pulse signals slowly rises and falls with time according to the first exemplary embodiment of the present invention, sudden voltage change of the cathode electrode 110 is lessened, and thus a slope is decreased as shown by the dotted line in the diagram illustrating the voltage $V_{cathode}$ of the cathode electrode In other words, as shown in FIG. 5, a pulse wave voltage is raised to a turn-on level at an earlier time than in the comparative example by increasing a turn-on duty of the pulse wave voltage, and the turn-on voltage level is gradually increased from $V_{min}$ to $V_{max}$, and then gradually decreased back to $V_{min}$ and turned off (wherein, the turn-off time may be later than that of the comparative example thereof). Thus the pulse wave voltage is an overall pentagonal pulse wave voltage.

Herein, duration time t and the voltage levels $V_{max}$ and $V_{min}$ of the gate voltage $V_{Qs}$ of the transistor Qs of a pentagonal wave shape decreasing the noise may be changed according to a duty value which is designated in order to maintain characteristics of the transistor Qs used and field emission.

Therefore, by changing $V_{max}$, $V_{min}$ and t, it is possible to determine an amount of field emission, that is, a duty of pulse driving.

In this way, the change rates in voltage of the cathode electrode 110 can be decreased by changing a waveform of the pulse voltage applied to the gate of the transistor Qs, and thus vibration of the metal mesh-type gate electrode 350 can be prevented.

Hereinafter, a field emission device according to second and third exemplary embodiments of the present invention will be described with reference to FIGS. 6 and 7.

Figure 6:
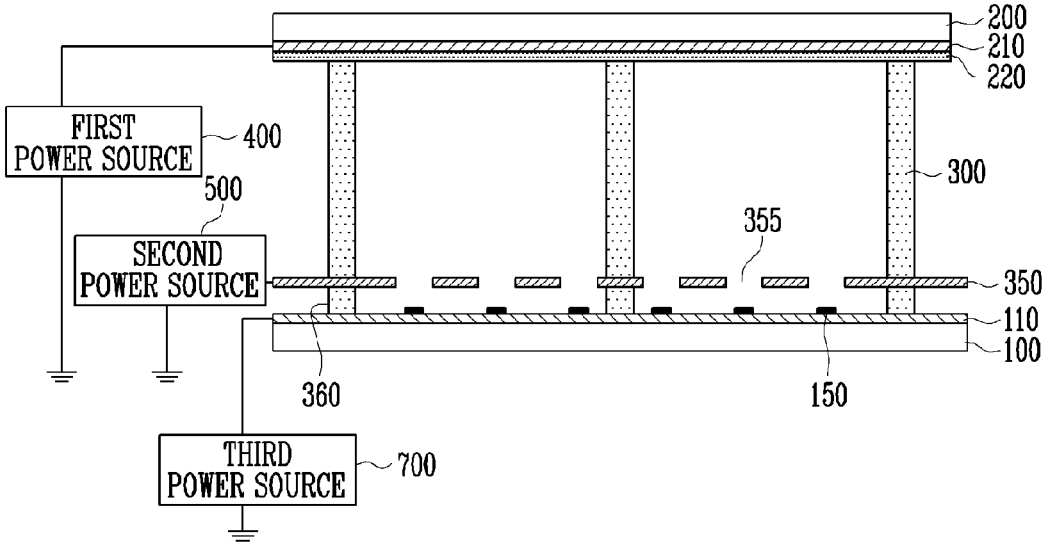
FIG. 6 is a cross sectional view of a field emission device according to a second exemplary embodiment of the present invention
Figure 7:
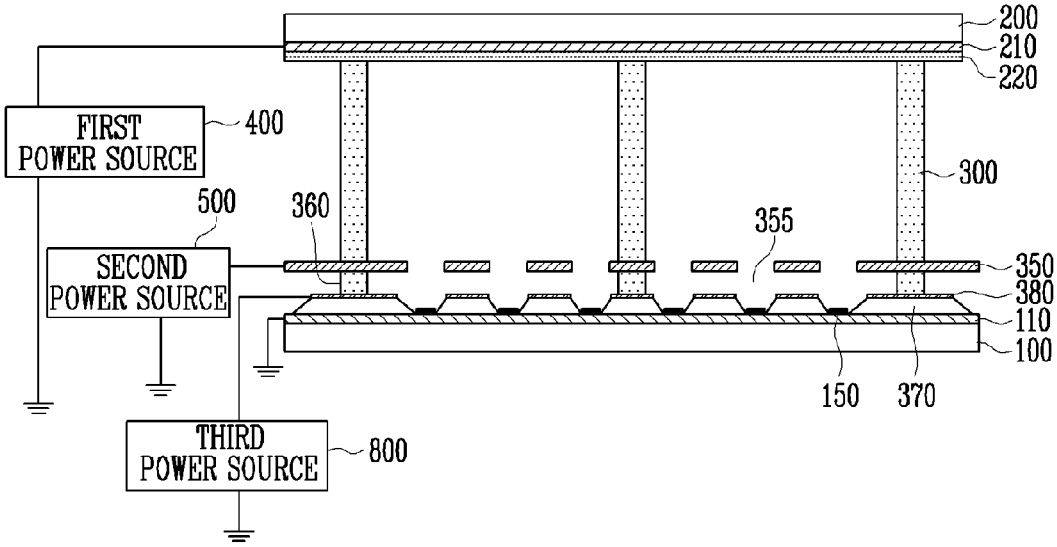
FIG. 7 is a cross sectional view of a field emission device according to a third exemplary embodiment of the present invention.

A structure shown in FIGS. 6 and 7 includes a basic structure of the field emission device shown in FIG. 1. FIGS. 6 and 7 illustrate a voltage drive-type field emission device.

The basic structure of the field emission device shown in FIG. 6 is the same as the field emission device shown in FIG. 1, and includes a first power source 400 supplying power to an anode electrode 210, a second power source 500 supplying power to a gate electrode 350, and a third power source 700 supplying power to a cathode electrode 110.

Here, because the second exemplary embodiment shown in FIG. 6 is a voltage drive type, a metal mesh-type gate electrode 350 acts as a gate inducing electron emission from field emitters 150.

Therefore, unlike FIG. 1, a high voltage pulse wave is directly applied to the gate electrode 350, and a voltage of a constant level is applied from the first and third power sources 400 and 700 to the anode electrode 210 and the cathode electrode 110, respectively.

Here, a pentagonal pulse wave voltage is applied as a pulse wave voltage applied to the gate electrode 350 by adjusting the duty and waveform as the gate voltage $V_{Qs}$ applied to the transistor Qs shown in FIG. 5, and thus a sudden voltage change of the gate electrode 350 is lessened, and it is possible to prevent is noise of the metal mesh.

Meanwhile, referring to FIG. 7, in the field emission device according to a third exemplary embodiment of the present invention, a first gate electrode 350 of a metal mesh type is formed between an anode substrate 200 and a cathode substrate 100, and a second gate electrode 380 is formed between the first gate electrode 350 and the cathode electrode 110.

The first gate electrode 350 is for concentrating emitted electrons, and the second gate electrode 380 acts as a gate inducing electron emission from field emitters 150.

The second gate electrode 380 is insulated from the cathode electrode 110 by spacers formed on the cathode electrode 110 as shown in FIG. 7.

As shown in FIG. 7, the cathode electrode 110 of the field emission device including the two gate electrodes 350 and 380 is grounded. The field emission device includes a first power source 400 applying a constant voltage to an anode electrode 210, a second power source 500 applying a voltage for concentrating emitted electrons to the first gate electrode 350 and a third power source 800 applying a high pulse wave voltage to the second gate electrode 380.

Although a constant high level voltage may be applied to the first gate electrode 350 as in the exemplary embodiment of FIG. 1, a non-constant level is voltage may also be applied according to the design.

A pulse wave voltage is applied to the second gate electrode 380, and thus electrons are emitted from the field emitters 150.

Here, as in FIG. 1, the first gate electrode 350 of a metal mesh type vibrates due to attraction and repulsion between the first and second gate electrodes 350 and 380, and may thus generate noise. Therefore, the third power source 800 applies a pentagonal pulse wave voltage to the second gate electrode 380 as shown in FIG. 5 to prevent the noise.

Accordingly, changes in voltage of the second gate electrode 380, i.e., slopes, are decreased, and thus noise of the first gate electrode 350 is decreased.

Here, during the voltage drive shown in FIGS. 6 and 7, high voltage pulses should be controlled unlike in the case of current drive.

Consequently, according to the present invention, noise from a metal mesh can be prevented without additional fabrication processes by modifying a waveform in pulse driving.

In the drawings and specification, there have been disclosed typical exemplary embodiments of the invention and, although specific terms are employed, they are used in a generic and descriptive sense only and not for purposes of limitation. As for the scope of the invention, it is to be set forth in the following claims. Therefore, it will be understood by those of ordinary skill in the art that various changes in form and details may be made therein without departing from the spirit and scope of the present invention as defined by the following claims.

What is claimed is:

1. A pulse drive-type field emission device comprising:

an anode substrate and a cathode substrate spaced apart from and facing each other;

a cathode electrode formed on the cathode substrate;

a field emitter formed on the cathode electrode;

a metal mesh-type gate electrode formed between the anode substrate and the cathode substrate, and having openings through which electrons emitted from the field emitter pass; and a power source configured to apply a compensated pulse wave voltage to the gate electrode or the cathode electrode which compensates for vibration of the gate electrode.

2. The pulse drive-type field emission device according to claim 1, wherein the power source comprises a cathode power source which applies power to the cathode electrode and a gate power source which applies power to the gate electrode.

3. The pulse drive-type field emission device according to claim 2, wherein the cathode power source comprises a current control device which controls a current flow in the cathode electrode.

4. The pulse drive-type field emission device according to claim 3, wherein the current control device comprises:

a pulse generator configured to generate a pulse voltage which repeatedly rises and falls according to time; and a transistor configured to receive the pulse voltage from the pulse generator and connect or disconnect the cathode electrode to the ground.

5. The pulse drive-type field emission device according to claim 4, wherein the pulse voltage applied to the transistor has a shape of a pentagonal wave.

6. The pulse drive-type field emission device according to claim 5, wherein a duty of the pentagonal wave and maximum and minimum values of a turn-on voltage are determined according to characteristics of the transistor.

7. The pulse drive-type field emission device according to claim 2, wherein the gate power source applies a pentagonal pulse wave voltage for inducing electron emission from the field emitter to the gate electrode, and the cathode power source applies a constant voltage according to time to the cathode electrode.

8. The pulse drive-type field emission device according to claim 2, further comprising:

an inducing gate electrode formed between the metal mesh-type gate electrode and the cathode electrode, and an inducing gate power source configured to apply inducing gate power to the inducing gate electrode.

9. The pulse drive-type field emission device according to claim 8, wherein the inducing gate power source applies a pentagonal pulse wave voltage to the inducing gate electrode.

10. The pulse drive-type field emission device according to claim 1, wherein the field emitter is formed of one of a carbon nano tube, a carbon nano fiber and carbonaceous synthetic materials.

11. A driving method of a pulse drive-type field emission device having an anode substrate, a stacked structure of a field emitter and a cathode electrode on a cathode substrate, the cathode substrate being spaced apart from and facing the anode substrate and a metal mesh-type gate electrode formed between the anode substrate and the cathode substrate, the method comprising:

applying a gate voltage to the gate electrode;

generating a pentagonal pulse wave voltage having a greater duty than a pulse duty of the cathode electrode, and decreasing a change rate in voltage of the cathode electrode by controlling a current of the cathode electrode according to the pentagonal pulse wave voltage.

12. The method according to claim 11, wherein the decreasing of the change rate in voltage of the cathode electrode comprises connecting or disconnect the cathode electrode to the ground by turning a transistor on or off according to the pentagonal pulse wave voltage.

13. The method according to claim 12, wherein a duty of the pentagonal pulse wave and maximum and minimum values of a turn-on voltage are determined according to characteristics of the transistor.

14. A driving method of a pulse drive-type field emission device having an anode substrate, a stacked structure of a field emitter and a cathode electrode on a cathode substrate, the cathode substrate being spaced apart from and facing the anode substrate and a gate electrode between the anode substrate and the cathode substrate, the method comprising:

applying a constant voltage with time to the cathode electrode;

generating a pentagonal pulse wave voltage having a greater duty than a pulse duty of the gate electrode; and applying the pentagonal pulse wave voltage to the gate electrode.

15. The method according to claim 14, wherein the gate electrode is a metal mesh-type electrode.

16. The method according to claim 14, wherein the field emission device comprises a metal mesh-type gate electrode and an inducing gate electrode, and the applying of the pentagonal pulse wave voltage comprises:

applying a constant voltage with time to the metal mesh-type gate electrode; and applying the pentagonal pulse wave voltage to the inducing gate electrode.

* * * * *